US007057447B1

(12) United States Patent
Tiwari

(10) Patent No.: US 7,057,447 B1
(45) Date of Patent: Jun. 6, 2006

(54) VOLTAGE REGULATOR USING A SINGLE VOLTAGE SOURCE AND METHOD

(75) Inventor: Chandra P. Tiwari, Bangalore (IN)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/793,430

(22) Filed: Mar. 4, 2004

(51) Int. Cl.
*G05F 1/10* (2006.01)

(52) U.S. Cl. ..... 327/541

(58) Field of Classification Search ..... 327/530, 327/534, 535, 540, 541, 560, 561, 562, 563
See application file for complete search history.

(56) References Cited

U.S. PATENT DOCUMENTS 5,136,182 A * 8/1992 Fawal ..... 327/541
5,321,653 A * 6/1994 Suh et al. ..... 365/189.09
5,349,559 A * 9/1994 Park et al. ..... 365/201
5,856,756 A * 1/1999 Sasahara et al. ..... 327/540
6,803,809 B1 * 10/2004 Saitoh ..... 327/541

* cited by examiner

*Primary Examiner*—Jeffrey Zweizig

(57) ABSTRACT

A voltage regulator formed on an integrated circuit is provided that includes a single voltage source and a bias voltage generator. The single voltage source comprises a reference voltage source that is operable to provide a reference voltage. The bias voltage generator is coupled to the reference voltage source and is operable to generate a bias voltage based on the reference voltage.

20 Claims, 2 Drawing Sheets

VOLTAGE REGULATOR USING A SINGLE VOLTAGE SOURCE AND METHOD

TECHNICAL FIELD OF THE INVENTION

The present invention relates generally to voltage regulation for integrated circuits and, more particularly, to a voltage regulator using a single voltage source and method.

BACKGROUND OF THE INVENTION

Business and consumers use a wide array of wireless devices, including cell phones, wireless local area network cards, global positioning system devices, electronic organizers equipped with wireless modems, and the like. The increased demand for wireless communication devices has created a corresponding demand for technical improvements to such devices. Generally speaking, more and more of the components of conventional radio receivers and transmitters are being fabricated in a single integrated circuit package. In order to simplify single chip designs and to make each design suitable for as many applications as possible, much emphasis has been placed on developing on-chip voltage regulators.

Many applications use on-chip voltage regulators to provide accurate regulated voltages for the core circuit on the chip. In these applications, the load is generally a large capacitive load. Thus, the reference voltages required for these applications have to be extremely accurate in order for the voltage regulators to generate accurate regulated output voltages.

Conventional voltage regulators include an error amplifier and two voltage sources. One voltage source provides a reference voltage and the other provides a bias voltage. The error amplifier generates an output voltage based on the reference and bias voltages provided by the voltage sources. However, disadvantages associated with conventional voltage regulators include relatively high, unavoidable output voltage variations due to process, temperature and voltage variations. These varying conditions may result in an output voltage swing of up to 200 mV, which is too high for some applications.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention and its advantages, reference is now made to the following description taken in conjunction with the accompanying drawings, wherein like reference numerals represent like parts, in which.

DETAILED DESCRIPTION OF THE INVENTION

Figure 1:
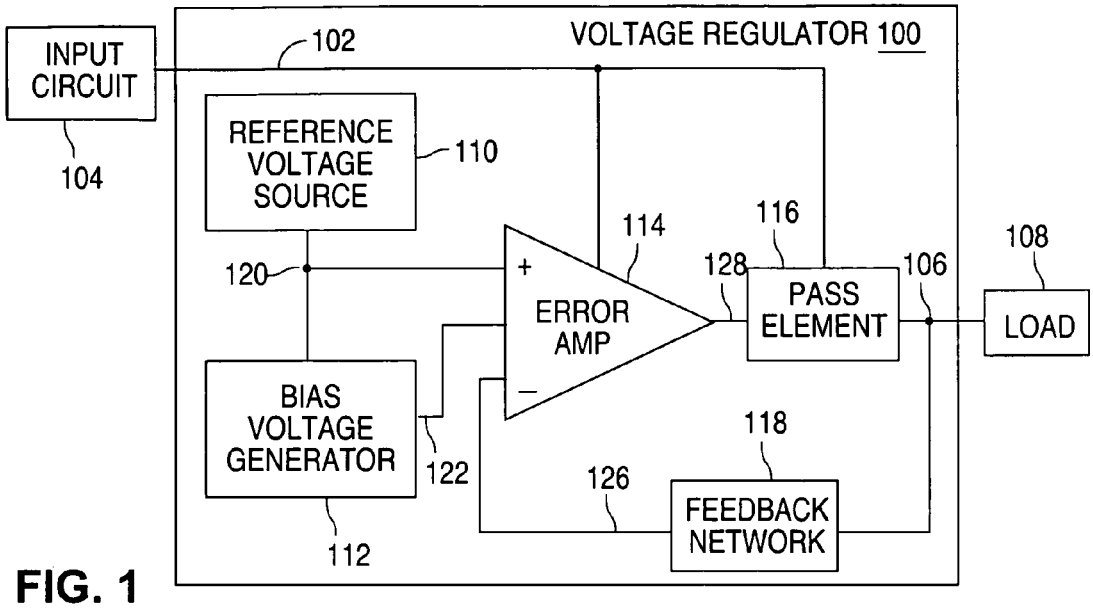
FIG. 1 is a block diagram illustrating a voltage regulator in accordance with one embodiment of the present invention.
Figure 2:
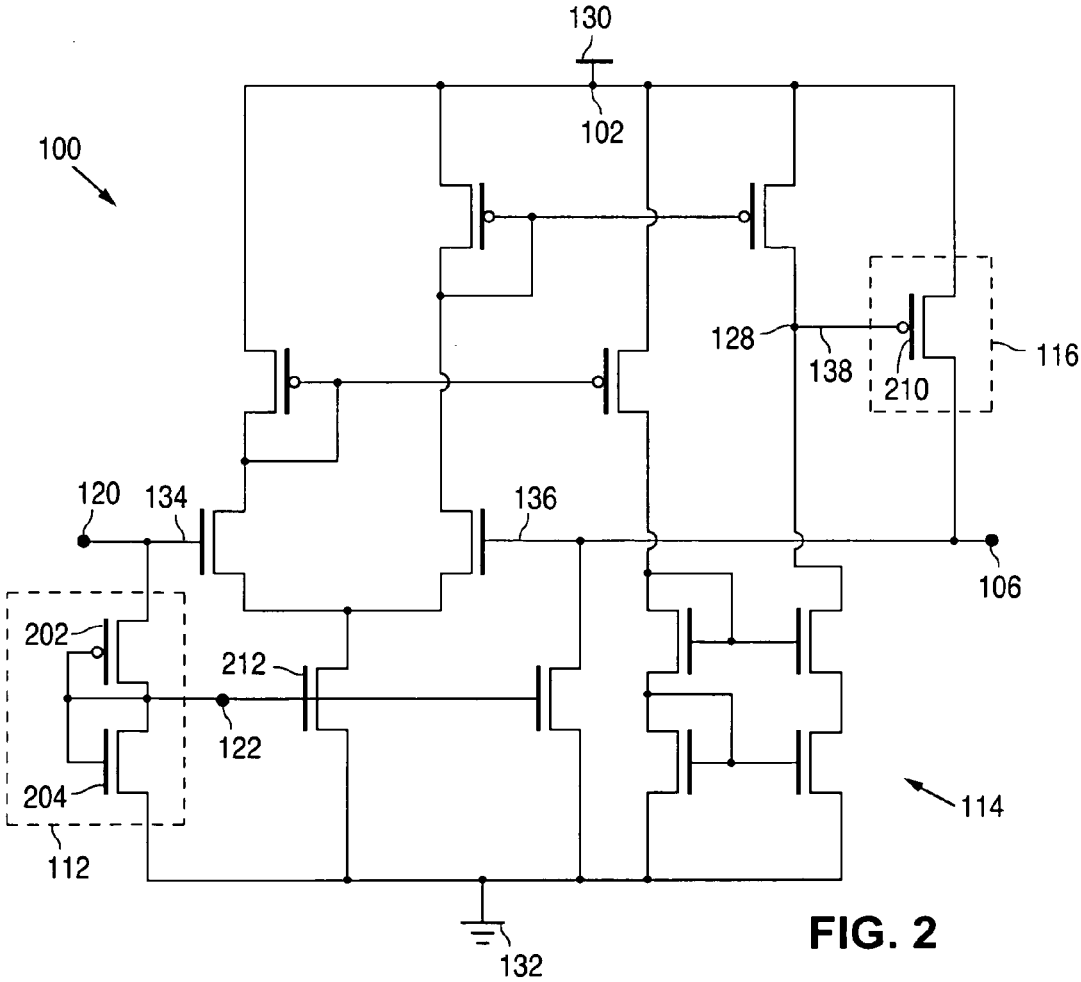
FIG. 2 is a circuit diagram illustrating the voltage regulator of FIG. 1 in accordance with one embodiment of the present invention.
Figure 3:
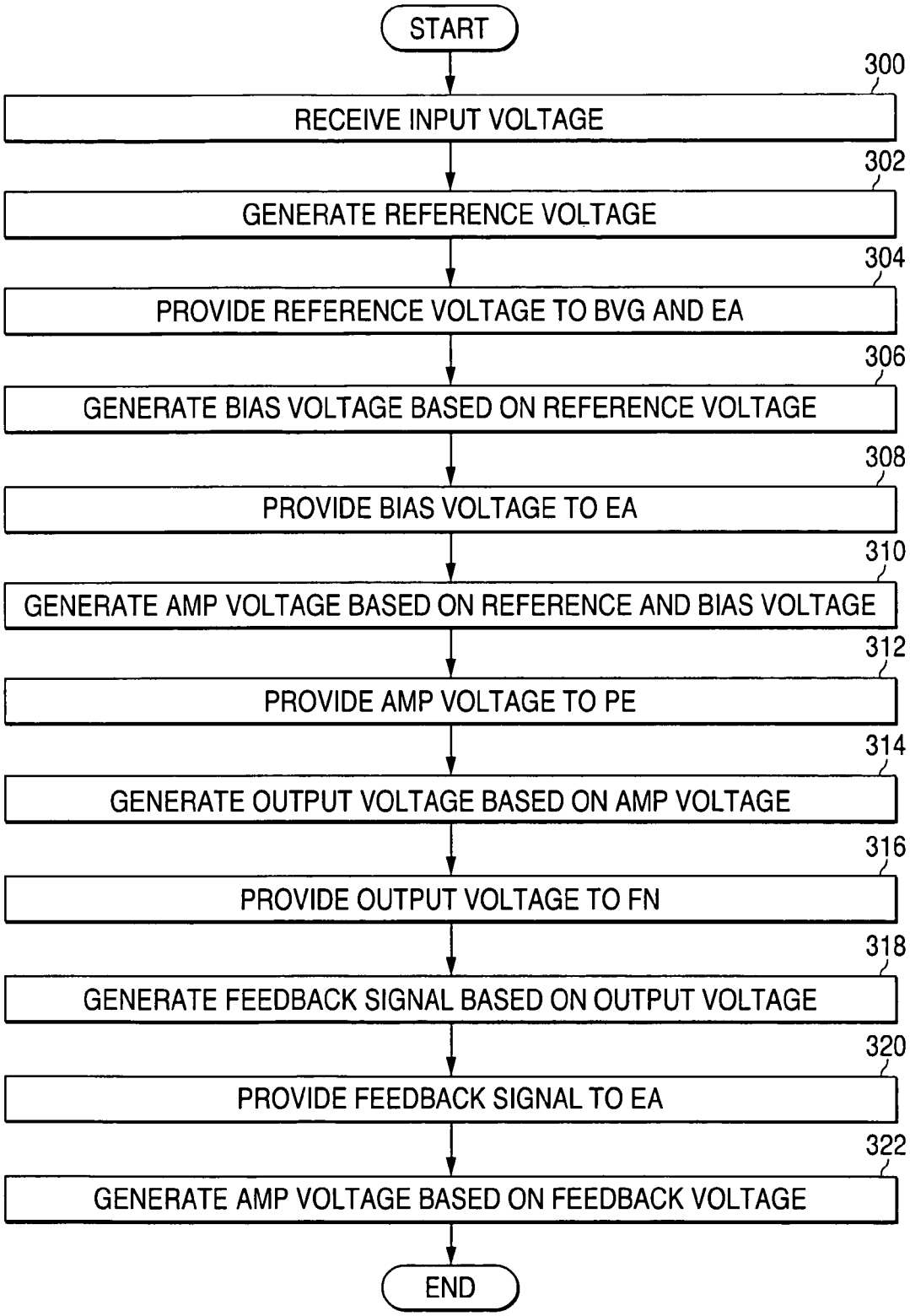
FIG. 3 is a flow diagram illustrating a method for regulating voltage using the voltage regulator of FIG. 1 in accordance with one embodiment of the present invention.

FIGS. 1 through 3, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged voltage regulator.

FIG. 1 is a block diagram illustrating a voltage regulator 100 in accordance with one embodiment of the present invention. The voltage regulator 100 is operable to receive a varying input voltage 102 from an input circuit 104 and to generate a relatively constant output voltage 106 for a load 108.

The voltage regulator 100 may be a component in a phase-locked loop, a voltage-controlled oscillator, or any other suitable circuit in a radio circuitry device, a remote-controlled device, or any other device using voltage regulation. For example, the voltage regulator 100 may be a component in a laptop computer, a cellular telephone, a pager, or any other suitable device.

In accordance with one embodiment of the present invention, the input circuit 104 may comprise a power supply that is operable to provide an input voltage 102 that may vary within a specified range of voltages. The load 108 may comprise one or more components that are operable to receive the output voltage 106.

The output voltage 106 generated by the voltage regulator 100 may comprise a relatively constant voltage, i.e., the output voltage 106 may vary within a significantly reduced range as compared to the input voltage 102. Thus, the output voltage 106 is regulated to be close to a desired voltage level regardless of the input voltage 102 when the input voltage 102 is within the specified range.

According to one embodiment, the input voltage 102 may comprise about 3.3 volts, while the output voltage 106 comprises about 2.5 volts. However, it will be understood that the input voltage 102 and the output voltage 106 may comprise any other suitable values without departing from the scope of the present invention. For this embodiment, the input voltage 102 may vary by about 200 millivolts and the output voltage 106 may vary less than 10 millivolts. Thus, the range of voltages for the input voltage 102 may comprise 3.2–3.4 volts, while the range of voltages for the output voltage 106 may comprise 2.495–2.505 volts.

According to the illustrated embodiment, the voltage regulator 100 comprises a reference voltage source 110, a bias voltage generator 112, an error amplifier 114, a pass element 116, and a feedback network 118. The reference voltage source 110 is coupled to the bias voltage generator 112 and to the error amplifier 114 and is operable to provide a reference voltage 120 for the voltage regulator 100. The bias voltage generator 112 is operable to receive the reference voltage 120 and to generate a bias voltage 122 based on the reference voltage 120.

The error amplifier 114, which may comprise a high gain amplifier, is coupled to the bias voltage generator 112 and the feedback network 118, in addition to the reference voltage source 110 and the input circuit 104. The error amplifier 114 is operable to receive the reference voltage 120, the bias voltage 122, and a feedback voltage 126 from the feedback network 118 and to generate an amplifier voltage 128 based on the reference voltage 120, the bias voltage 122, and the feedback voltage 126. The pass element 116 is coupled to the error amplifier 114, in addition to the input circuit 104 and the load 108, and is operable to receive the amplifier voltage 128 and to generate the output voltage 106 based on the amplifier voltage 128.

The feedback network 118 is coupled to the pass element 116 and the error amplifier 114. The feedback network 118 is operable to receive the output voltage 106 from the pass element 116, to generate the feedback voltage 126 based on the output voltage 106, and to provide the feedback voltage 126 to the error amplifier 114. In operation, the reference voltage source 110 provides the reference voltage 120 to the bias voltage generator 112 and to the error amplifier 114. The bias voltage generator 112 generates the bias voltage 122 based on the reference voltage 120 and provides the bias voltage 122 to the error amplifier 114. The error amplifier 114, through the pass element 116, regulates the output voltage 106 for the load 108 based on the reference voltage 120 and the bias voltage 122.

The feedback network 118 receives the output voltage 106 and generates the feedback voltage 126 based on the output voltage 106. The feedback network 118 provides the feedback voltage 126 to the error amplifier 114. The error amplifier 114, through the pass element 116, regulates the output voltage 106 for the load 108 based on the feedback voltage 126, in addition to the reference voltage 120 and the bias voltage 122.

FIG. 2 is a circuit diagram illustrating the voltage regulator 100 in accordance with one embodiment of the present invention. According to this embodiment, the input circuit 104 (not explicitly shown in FIG. 2) is provided by a power supply, $V_{DD}$, 130 and a ground, $V_{SS}$, 132. The power supply 130 is operable to provide the input voltage 102 with respect to ground 132.

According to one embodiment, the power supply 130 is operable to provide about 3.3 volts, while the ground 132 is operable to provide about 0 volts. However, it will be understood that the power supply 130 may provide any suitable power supply potential, and the ground 132 may provide any suitable potential less than the potential provided by the power supply 130.

The power supply 130 is also operable to provide power to the error amplifier 114 and to the pass element 116. In addition, the ground 132 is operable to provide the ground potential to the bias voltage generator 112, the error amplifier 114, and the feedback network 118 (not illustrated in FIG. 2).

According to the illustrated embodiment, the error amplifier 114 comprises an operational amplifier, which comprises a non-inverting input terminal 134, an inverting input terminal 136 and an output terminal 138. The non-inverting input terminal 134 is coupled to the reference voltage source 110 (not illustrated in FIG. 2) and, thus, is operable to receive the reference voltage 120. The inverting input terminal 136 is coupled to the feedback network 118. The output terminal 138 is coupled to the pass element 116. The output terminal 138 is operable to generate the amplifier voltage 128. Thus, the error amplifier 114 is operable, in conjunction with the pass element 116, to generate the regulated output voltage 106.

According to the illustrated embodiment, the voltage regulator 100 comprises a plurality of metal-oxide semiconductor field-effect transistors (MOSFETs), with the exception of the feedback network 118 which may comprise a resistive network or any other suitable combination of components. For this embodiment, the bias voltage generator 112 comprises a p-channel MOSFET 202 and an n-channel MOSFET 204. The sizes of the MOSFETs 202 and 204 correspond to a low quiescent current.

The source of the p-channel MOSFET 202 is coupled to the reference voltage source 110 and is operable to receive the reference voltage 120 from the reference voltage source 110. The drains and gates of the MOSFETs 202 and 204 are coupled to each other, and the source of the n-channel MOSFET 204 is coupled to the ground 132. The bias voltage generator 112 is operable to generate the bias voltage 122 at the drains and gates of the MOSFETs 202 and 204.

For the illustrated embodiment, the pass element 116 comprises another p-channel MOSFET 210, while the error amplifier 114 comprises the remaining MOSFETs. The MOSFETs 202 and 204 of the bias voltage generator 112 are operable to control the tail current of one of the n-channel MOSFETs 212 of the error amplifier 114 in order to maintain the output voltage 106 within a relatively small range, as previously described.

The MOSFET 210 of the pass element 116 may comprise a relatively large transistor that provides a relatively high current, for example, on the order of 50 milliamps. However, it will be understood that the MOSFET 210 may provide any suitable current without departing from the scope of the present invention.

The gate of the MOSFET 210 is coupled to the output terminal 138 of the error amplifier 114. The source of the MOSFET 210 is coupled to the power supply 130, and the drain of the MOSFET 210 is coupled to the load 108 (not illustrated in FIG. 2). Thus, the output voltage 106 of the voltage regulator 100 is generated at the drain of the pass element 116.

In operation, the input voltage 102 is provided to the error amplifier 114 by the power supply 130 and the ground 132. In addition, the power supply 130 provides power to the pass element 116, and the ground 132 is provided to the source of the n-channel MOSFET 204 of the bias voltage generator 112. The reference voltage source 110 generates the reference voltage 120 and provides the reference voltage 120 to the source of the p-channel MOSFET 202 of the bias voltage generator 112 and to the non-inverting input terminal 134 of the error amplifier 114.

The bias voltage generator 112 generates the bias voltage 122 based on the reference voltage 120 and provides the bias voltage 122 from the gates and drains of the MOSFETs 202 and 204 to the MOSFET 212 of the error amplifier 114. The error amplifier 114 also receives the feedback voltage 126 from the feedback network 118.

Based on the bias voltage 122, the error amplifier 114 amplifies the difference between the reference voltage 120 and the feedback voltage 126 to generate the amplifier voltage 128 at the output terminal 138 of the error amplifier 114. The pass element 116 receives the amplifier voltage 128 at the gate of the MOSFET 210 and generates, at the drain of the MOSFET 210, the output voltage 106 based on the amplifier voltage 128. In this way, the error amplifier 114, through the pass element 116, regulates the output voltage 106 of the voltage regulator 100.

FIG. 3 is a flow diagram illustrating a method for regulating voltage using the voltage regulator 100 in accordance with one embodiment of the present invention. The method begins at step 300 where the voltage regulator 100 receives an input voltage 102 at the error amplifier 114 and the pass element 116.

At step 302, the reference voltage source 110 generates a reference voltage 120 for the voltage regulator 100. At step 304, the reference voltage source 110 provides the reference voltage 120 to the bias voltage generator (BVG) 112 and to the error amplifier (EA) 114. At step 306, the bias voltage generator 112 generates a bias voltage 122 based on the reference voltage 120. At step 308, the bias voltage generator 112 provides the bias voltage 122 to the error amplifier 114.

At step 310, the error amplifier 114 generates an amplifier voltage 128 based on the reference voltage 120 and the bias voltage 122. At step 312, the error amplifier 114 provides the amplifier voltage 128 to the pass element (PE) 116. At step 314, the pass element 116 generates the output voltage 106 based on the amplifier voltage 128.

At step 316, the output voltage 106 is provided to the feedback network (FN) 118. At step 318, the feedback network 118 generates a feedback signal 126 based on the output voltage 106. At step 320, the feedback network 118 provides the feedback signal 126 to the error amplifier 114. At step 322, the error amplifier 114 continues to generate the amplifier voltage 128 based on the reference voltage 120 and the bias voltage 122 and also based on the feedback voltage 126, at which point the method comes to an end. In generating the amplifier voltage 128, the error amplifier 114 amplifies, based on the bias voltage 122, a difference between the reference voltage 120 and the feedback voltage 126.

In this way, the voltage regulator 100 may use a bias voltage 122 that is generated based on a reference voltage 120, allowing the voltage regulator 100 to regulate the output voltage 106 using a single voltage source, i.e., the reference voltage source 110. This results in a swing of less than 10 millivolts in the output voltage 106. Thus, using this method, the effects of process, temperature and voltage variations on the output voltage 106 are greatly reduced.

Although the present invention has been described with several embodiments, various changes and modifications may be suggested to one skilled in the art. It is intended that the present invention encompass such changes and modifications as fall within the scope of the appended claims.

What is claimed is:

1. A voltage regulator formed on an integrated circuit, comprising:

a single voltage source comprising a reference voltage source, the reference voltage source operable to provide a reference voltage;

a bias voltage generator coupled to the reference voltage source, the bias voltage generator operable to generate a bias voltage based on the reference voltage; and an error amplifier coupled to the reference voltage source and the bias voltage generator, the error amplifier operable to amplify, based on the bias voltage, a difference between the reference voltage and a feedback voltage to generate an amplifier voltage;

wherein the bias voltage generator comprises a p-channel MOSFET and an n-channel MOSFET, a source of the p-channel MOSFET is coupled to the reference voltage source, and a gate and a drain of the p-channel MOSFET and a gate and a drain of the n-channel MOSFET are coupled to the error amplifier.

2. The voltage regulator of claim 1, further comprising a pass element coupled to the error amplifier, the pass element operable to generate a regulated output voltage based on the amplifier voltage.

3. The voltage regulator of claim 2, further comprising a feedback network coupled to the pass element and the error amplifier, the feedback network operable to generate the feedback voltage based on the output voltage and to provide the feedback voltage to the error amplifier.

4. The voltage regulator of claim 2, the pass element comprising a p-channel MOSFET.

5. The voltage regulator of claim 1, wherein:

the voltage regulator is capable of receiving a varying input voltage; and the bias voltage generator is capable of generating the bias voltage based on the reference voltage and without using the varying input voltage.

6. The voltage regulator of claim 3, wherein the feedback network comprises a resistive network.

7. A method for regulating an output voltage for a voltage regulator, the voltage regulator comprising a single voltage source, the method comprising:

providing a reference voltage for the voltage regulator;

generating a bias voltage based on the reference voltage; and amplifying, based on the bias voltage a difference between the reference voltage and a feedback voltage to generate an amplifier voltage;

wherein generating the bias voltage comprises using a p-channel MOSFET and an n-channel MOSFET, the bias voltage generated at a gate and a drain of the p-channel MOSFET and a gate and a drain of the n-channel MOSFET.

8. The method of claim 7, further comprising regulating the output voltage based on the reference voltage and the bias voltage.

9. The method of claim 7, further comprising generating the output voltage based on the amplifier voltage.

10. The method of claim 9, further comprising generating the feedback voltage based on the output voltage.

11. The method of claim 7, wherein:

the voltage regulator is capable of receiving a varying input voltage; and generating the bias voltage comprises generating the bias voltage based on the reference voltage and without using the varying input voltage.

12. The method of claim 10, wherein generating the feedback voltage comprises generating the feedback voltage using a resistive network.

13. A method for regulating an output voltage for a voltage regulator, comprising:

providing a single voltage source for the voltage regulator, the voltage source comprising a reference voltage source;

providing a reference voltage with the reference voltage source;

generating a bias voltage based on the reference voltage using a bias voltage generator, the bias voltage generator comprising a p-channel MOSFET and an n-channel MOSFET, the bias voltage generated at a gate and a drain of the p-channel MOSFET and a gate and a drain of the n-channel MOSFET; and amplifying, based on the bias voltage, a difference between the reference voltage and a feedback voltage to generate an amplifier voltage.

14. The method of claim 13, further comprising regulating the output voltage based on the reference voltage and the bias voltage.

15. The method of claim 13, wherein the gate and the drain of the p-channel MOSFET are coupled to the gate and the drain of the n-channel MOSFET.

16. The method of claim 13, further comprising generating the output voltage based on the amplifier voltage.

17. The method of claim 16, further comprising generating the feedback voltage based on the output voltage.

18. The method of claim 16, generating the output voltage based on the amplifier voltage comprising generating the output voltage with a pass element, the pass element comprising a p-channel MOSFET.

19. The method of claim 13, wherein:

the voltage regulator is capable of receiving a varying input voltage; and generating the bias voltage comprises generating the bias voltage based on the reference voltage and without using the varying input voltage.

20. The method of claim 17, wherein generating the feedback voltage comprises generating the feedback voltage using a resistive network.

* * * * *